US011096501B2

(12) United States Patent
Kujawa

(10) Patent No.: US 11,096,501 B2
(45) Date of Patent: Aug. 24, 2021

(54) BEDDING RETENTION ASSEMBLY

(71) Applicant: Daniel Kujawa, Birmingham, MI (US)

(72) Inventor: Daniel Kujawa, Birmingham, MI (US)

( * ) Notice: Subject to any disclaimer, the term of this patent is extended or adjusted under 35 U.S.C. 154(b) by 0 days.

(21) Appl. No.: 16/729,318

(22) Filed: Dec. 28, 2019

(65) Prior Publication Data

US 2021/0196050 A1 Jul. 1, 2021

(51) Int. Cl.
*A47C 21/02* (2006.01)

(52) U.S. Cl.
CPC ..... *A47C 21/022* (2013.01)

(58) Field of Classification Search
CPC ..... A47C 21/022; Y10T 24/23
See application file for complete search history.

(56) References Cited

U.S. PATENT DOCUMENTS

| | | | | |
|---|---|---|---|---|
| 2,930,053 | A * | 3/1960 | Nowels | A47C 21/022 5/498 |
| 4,045,832 | A | 9/1977 | DiForti | |
| 4,336,635 | A | 6/1982 | Lantz | |
| 4,506,398 | A | 3/1985 | Hruban | |
| 4,646,375 | A | 3/1987 | Parker | |
| 5,092,009 | A | 3/1992 | Griffith | |
| 5,325,554 | A | 7/1994 | Lewis | |
| 5,327,595 | A | 7/1994 | Allen | |
| 5,467,491 | A | 11/1995 | Griffith | |
| 5,555,578 | A | 9/1996 | Wyatt | |
| 5,557,814 | A | 9/1996 | Cybulski | |
| 5,815,861 | A | 10/1998 | LaGrange | |
| 6,739,002 | B1 | 5/2004 | Pannu | |
| 6,836,913 | B2 | 1/2005 | Perrin | |
| 7,698,759 | B1 | 4/2010 | Frasier | |
| 8,032,959 | B2 | 10/2011 | Rowson | |
| 8,321,975 | B1 | 12/2012 | Lindberg | |
| 8,627,521 | B2 | 1/2014 | Rowson | |
| 8,745,787 | B1 | 6/2014 | Heimlich | |
| 9,492,022 | B2 | 11/2016 | Nekhala | |
| 9,510,698 | B1 | 12/2016 | Krotova | |
| 9,980,577 | B1 | 5/2018 | Coussens | |

* cited by examiner

*Primary Examiner* — Robert Sandy
*Assistant Examiner* — Louis A Mercado
(74) *Attorney, Agent, or Firm* — Simonelli IP, PLLC

(57) ABSTRACT

A bedding retention assembly retains a fitted sheet over a mattress. The bedding retention assembly includes at least one base disposed adjacent the mattress. The base is flat in one embodiment and has a flange extending perpendicularly thereto in a second embodiment. At least one boss extends out from the at least one base. Each of a plurality of lines is partially redirected by the at least one boss. Each of the plurality of lines includes an attachment portion and a tightening portion. A plurality of attachment devices is fixedly secured to each of the attachment portions for attaching a portion of the bedding periphery to the bedding retention assembly.

9 Claims, 5 Drawing Sheets

BEDDING RETENTION ASSEMBLY

BACKGROUND OF THE INVENTION

1. Field of the Invention

The invention relates to bedding. More particularly, the invention relates to an assembly used to retain bedding in a desired position.

2. Description of the Related Art

Sheets are used to cover surfaces on which when human beings sleep. Often times, the sheets move due to the movement of those sleeping on the surface, which is typically a mattress. Fitted sheets attempt to solve the problem of maintaining coverage of the mattress throughout the night. Fitted sheets do not, however, satisfactorily maintain position through the night.

SUMMARY OF THE INVENTION

A bedding retention assembly retains bedding having a bedding periphery over a mattress. The bedding retention assembly includes at least one base disposed adjacent the mattress. At least one boss extends out from the at least one base. Each of a plurality of lines is partially redirected by said at least one boss. Each of the plurality of lines includes an attachment portion and a tightening portion. A plurality of attachment devices is fixedly secured to each of the attachment portions for attaching a portion of the bedding periphery to the bedding retention assembly.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE INVENTION

Figure 1:
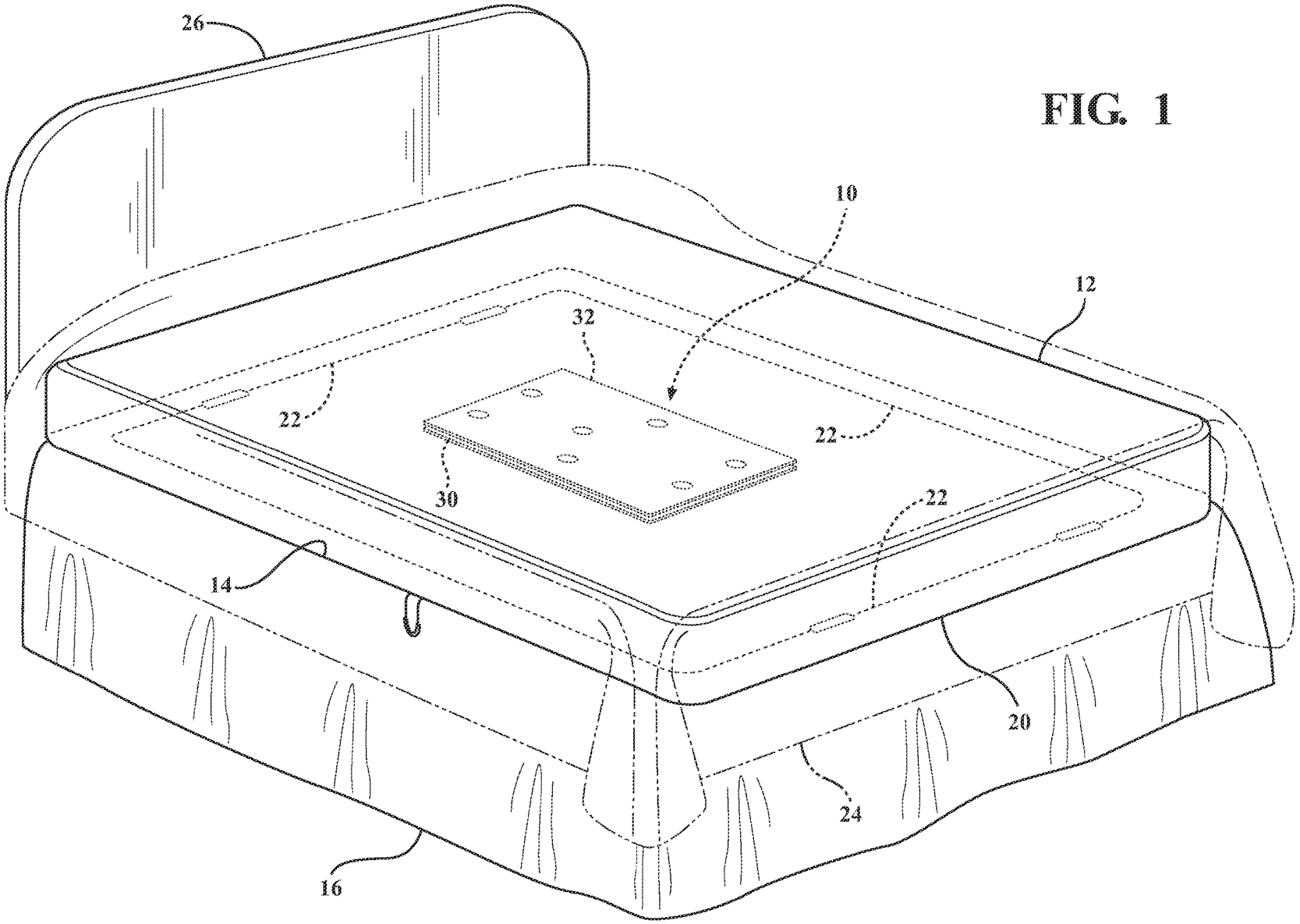
FIG. 1 is a perspective view of a bed with a bedding retention assembly shown in phantom.
Figure 2:
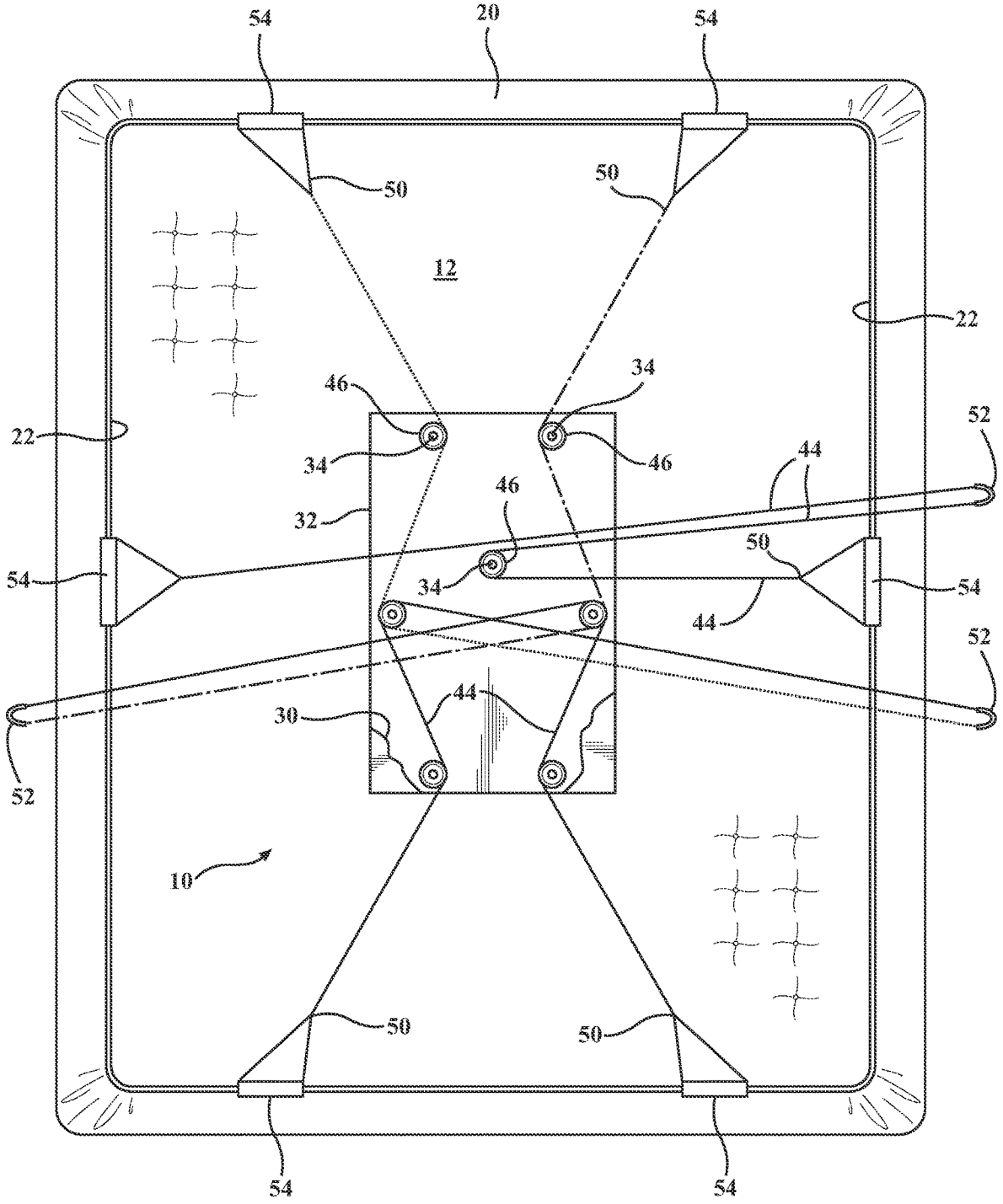
FIG. 2 is a bottom view of a mattress with bedding being retained by a first embodiment of the bedding retention assembly, with the base shown cut away.

Referring to FIG. 1, a first embodiment of the bedding retention assembly is generally indicated at 10 and is shown in phantom. The retention bedding assembly 10 is disposed adjacent a structure 12 upon which a person sleeps. In the embodiment shown, this structure is a mattress 12. The mattress 12 rests upon a surface 14. In the embodiment shown, the surface 14 is a top surface of a box spring 16, which is covered by a decorative covering 16. The box spring 16 either sits on a frame or the floor (neither shown).

A piece of bedding 20 extends over the mattress 12. As is shown in FIG. 1, the piece of bedding 20 is a fitted sheet. The bedding 20 defines a bedding periphery 22, shown in phantom extending between the mattress 12 and the box spring 16 in FIG. 1. A bedspread 22 is shown in phantom over the fitted sheet 20. The bedspread 22 is elevated away from the mattress 12 near the head of the mattress 12, represented by a headboard 26 due to pillows (not shown) placed between the bedding 20/mattress 12 and the bedspread 24.

The bedding retention assembly 10 includes at least one base 30 disposed adjacent the mattress 12. More specifically, the base 30 is disposed underneath the mattress 12. The base 30 is shown to the rectangular in shape and extends through a first plane (defined as the plane extending between the mattress 12 and the box spring 16). It should be appreciated by those skilled in the art that the base 30 may extend through any type of shape deemed appropriate for the shape of mattress 12 and bedding 20 being retained. The base 30 includes a base cover 32 which extends along the same periphery as the base 30. The base cover 32 will be discussed in greater detail subsequently.

Figure 3:
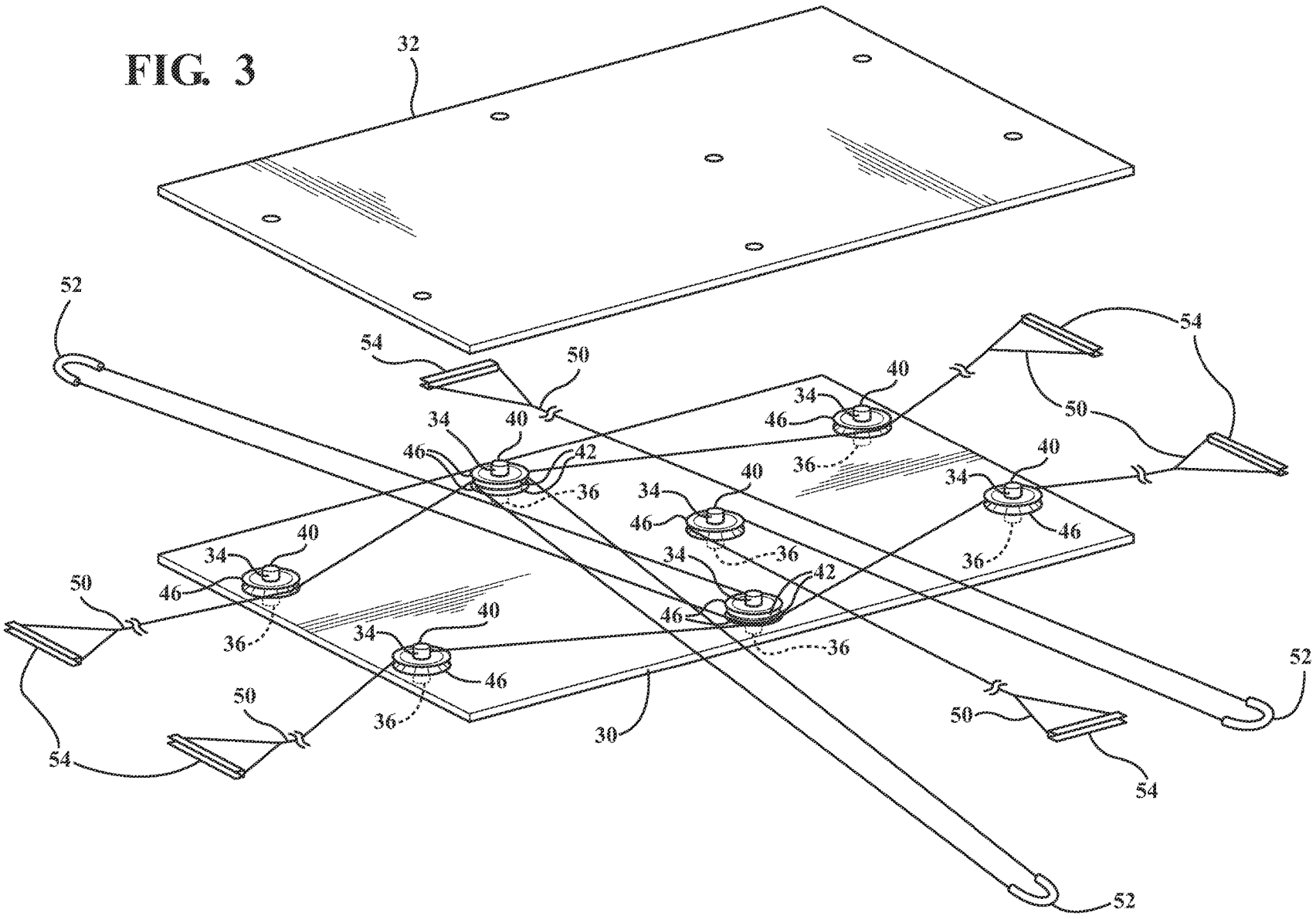
FIG. 3 is an exploded perspective view of the first embodiment of the bedding retention assembly.

At least one boss 34 extends out from the at least one base 30. The boss 34 extends up in the base 30 perpendicularly thereto. The boss 34 is a cylinder having a circular cross-section extending between a base end 36 and a cover end 40 (best seen in FIG. 3). The boss includes a channel 42 that receives a line 44 therein. The boss 34 may include a plurality of channels 42 extending around his body between the base end 36 in the cover end 40 thereof. In the embodiment shown, each of the bosses 34 includes at least one pulley 46 about which a line 44 extends around. In an alternative embodiment, each boss 34 will include a plurality of pulleys 46 stacked one upon the other, each receiving a portion of a line 44 therein.

The bedding retention assembly 10 also includes a plurality of lines 44 that extend between the bedding periphery 22 and an edge of the mattress 12. The plurality of lines 44 are redirected by the at least one boss 34 and/or the pulley 46 that may rotate about the boss 34. Each of the plurality of lines 44 is redirected by the retention bedding assembly 10. Each of the plurality lines 44 extends between an attachment portion 50 and a tightening portion 52. The attachment portion 50 is disposed adjacent the bedding periphery 22, whereas the tightening portion 52 is disposed adjacent the outer periphery of the mattress 12.

The base cover 32 extends over the base 30 and receives the cover end 40 of each of the bosses 34. This prevents the lines 44 from inadvertently losing its spatial relationship with the boss 34 to which it is associated.

A plurality of attachment devices 54 are used to secure the attachment portion 50 of line 44 to the bedding 20. As one option, the attachment device 54 is a clamp that clamps onto the bedding 20 at the bedding periphery 22.

In operation, the plurality of lines 44 are fed through the base 30 so that the attachment portions 50 are exposed and away from the base 30. The bedding retention assembly 10 is then placed underneath the mattress 12. In the first embodiment, the bedding retention assembly 10 is placed between the mattress 12 and the box spring 16. The attachment devices 54 are secured to the bedding periphery 22. The tightening portions 52 of the lines 44 are pulled tight preventing the bedding periphery 22 from leaving its position between the mattress 12 and the box spring 16. Because the bedding retention assembly 10 utilizes bosses 34 and/or pulleys 46 to redirect the forces applied to the lines 44 at the tightening portion 52 thereof, the number of tightening portions 52 is less than the number of attachment portions 50. The tightening portions 52 of the lines 44 are generally held in place through the mere weight of the mattress 12 pressing down on the lines 44 exposed to the mattress 12 between the mattress 12 in the box spring 16.

In a second embodiment, wherein like primed numerals represent similar elements as those discussed above with respect to the first embodiment, the base 30' includes a flange 56 that extends through a second flat plane perpendicular to the first flat plane. The flange 56 extend out of a portion of the base 30' which is not disposed between the mattress 12 and the box spring 16. In this embodiment, the base 30' would extend along a side of the mattress 12 and/or the box spring 16 (best seen in FIG. 5).

Figure 4:
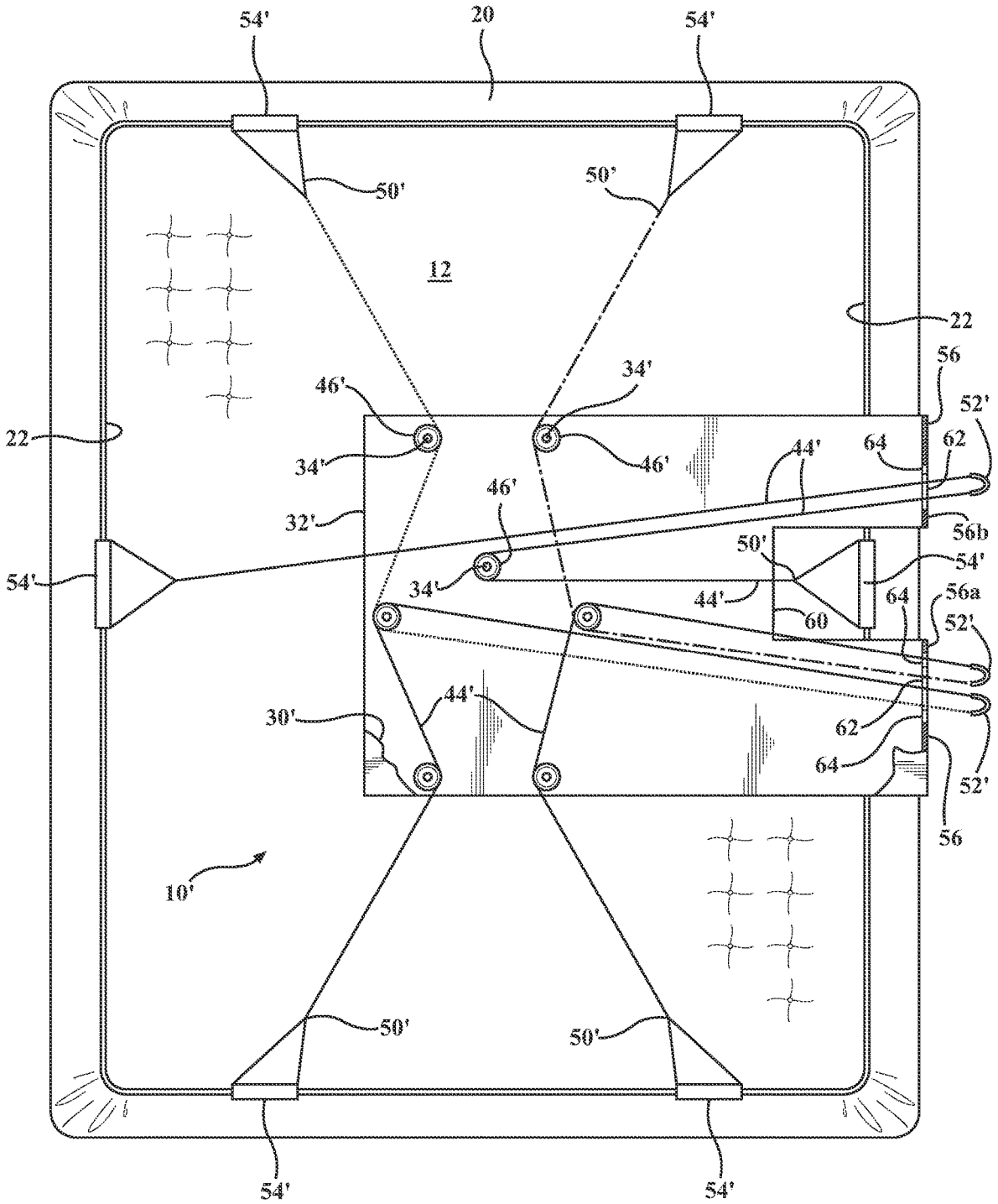
FIG. 4 is a bottom view of a mattress with bedding being retained by a second embodiment of the bedding retention assembly, with the base shown cut away.
Figure 5:
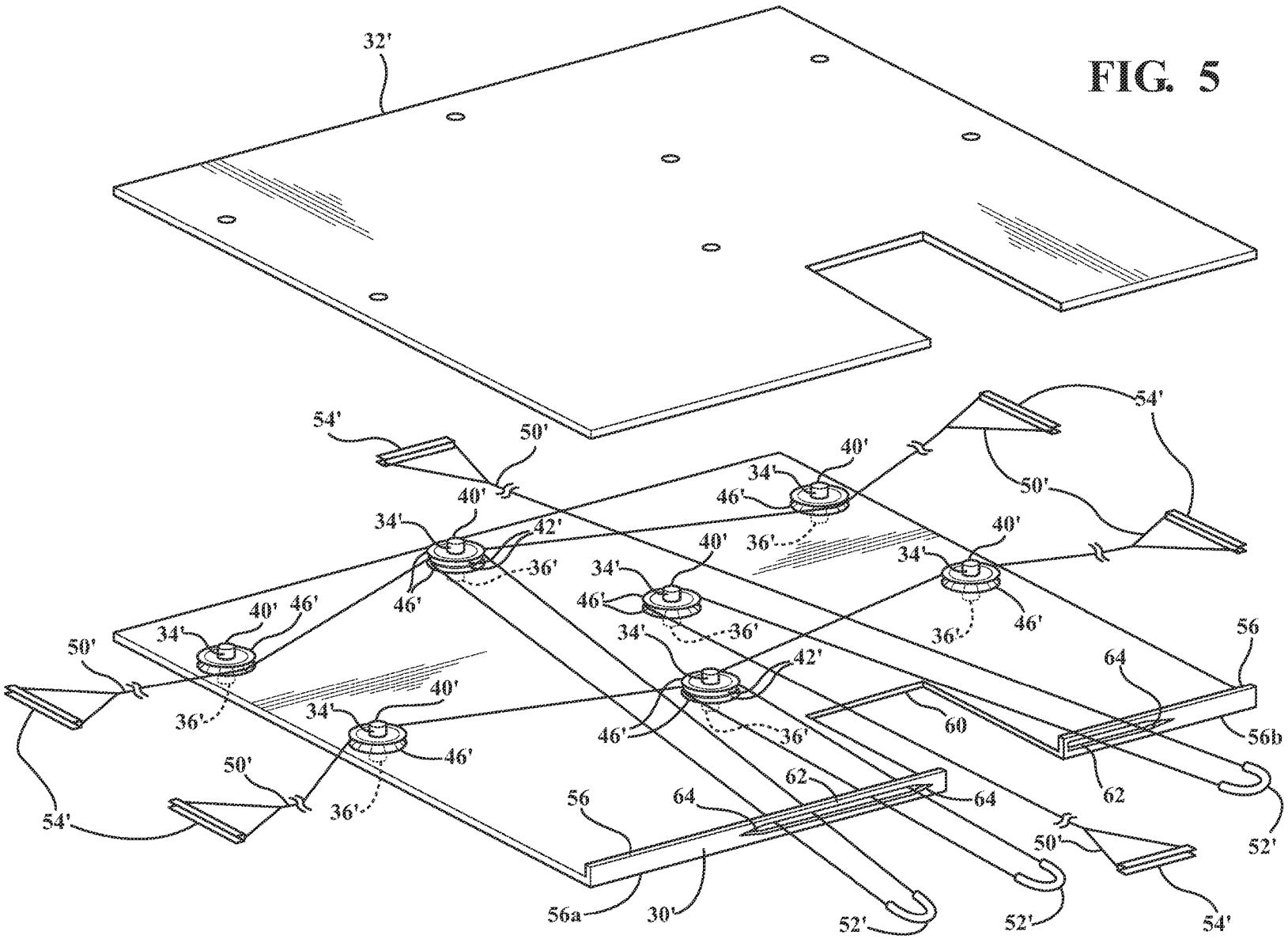
FIG. 5 is an exploded perspective view of the second embodiment of the bedding retention assembly.

In the embodiment shown in FIGS. 4 and 5, the base 30' and flange 56 define a cut-out 60 to provide space for one of the attachment devices 54' to be positioned in line with the base 30'. In this embodiment the flange 56 defines two halves 56*a*, 56*b*.

The flange 56 includes at least one aperture 62 through which at least one tightening portion 52' extends. In the embodiment shown, each half 56*a*, 56*b* of the second flat plane 56 includes an aperture 62. The aperture(s) 62 include securing ends 64 that secure the tightening portions 52' in place. The securing ends 64 have dimensions reduced from the aperture(s) 62, and when the tightening portion 52' is moved into one of the securing ends 64, the securing ends 64 provide a friction lock to secure the tightening portion 52' in position. While it is shown that the base cover 32' extends all the way to the second flat plane 56, other embodiments would include a base cover 32' that extends only to the edge of the cut-out 60.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. A bedding retention assembly for retaining bedding, defining a bedding periphery, over a mattress, said bedding retention assembly comprising:

at least one base disposed adjacent the mattress, said at least one base including a flange extending perpendicular to said at least one base, said flange defines at least one aperture through which at least one of plurality of lines extends;

a plurality of bosses extending out from said at least one base;

said plurality of lines each partially redirected by said plurality of bosses, each of said plurality of lines including an attachment portion and a tightening portion; and a plurality of attachment devices fixedly secured to each of said attachment portions for attaching a portion of the bedding periphery to said bedding retention assembly, whereby tightening each of said plurality of lines by pulling on said tightening portions pulls the attachment portions and the bedding periphery to maintain the bedding periphery in position with respect to the mattress.

2. The bedding retention assembly as set forth in claim 1 wherein each of said plurality of bosses includes a channel to receive at least one of said plurality of lines therein.

3. The bedding retention assembly as set forth in claim 1 wherein said plurality of bosses includes a plurality of channels, each receiving one of said plurality of lines therein.

4. The bedding retention assembly as set forth in claim 1 wherein each of said plurality of bosses includes at least one pulley defining a channel to receive at least one of said plurality of lines therein, said at least one pulley facilitating redirection of forces generated by pulling said at least one of the plurality of lines.

5. The bedding retention assembly as set in claim 4 wherein at least one of said plurality of bosses includes a plurality of pulleys, each defining a channel to receive said at least one of said plurality of lines therein, each of said plurality of pulleys enabling the redirection of forces generated by pulling said plurality of lines.

6. The bedding retention assembly as set forth in claim 1 wherein said at least one aperture includes securing ends to frictionally hold said at least one of said plurality of lines in position.

7. The bedding retention assembly as set forth in claim 6 wherein said base defines a first flat plane and said flange defines a second flat plane wherein said first and second flat planes are perpendicular to each other.

8. The bedding retention assembly as set forth in claim 7 wherein said flange defines a cut-out to position one of said plurality of attachment devices therein.

9. The bedding retention assembly as set forth in claim 1 wherein each of said plurality of attachment devices is a clamp used to retain a portion of the bedding periphery therein.

* * * * *